United States Patent [19]

Frentress

[11] 4,160,359

[45] Jul. 10, 1979

[54] RANDOM SIGNAL GENERATOR FOR THE MANUFACTURE OF SLUB OPEN END SPUN YARN

[75] Inventor: Zane Frentress, Stone Mountain, Ga.

[73] Assignee: Milliken Research Corporation, Spartanburg, S.C.

[21] Appl. No.: 899,151

[22] Filed: Apr. 24, 1978

[51] Int. Cl.[2] ..... D01H 1/12

[52] U.S. Cl. ..... 57/58.89; 57/91; 57/209

[58] Field of Search ..... 57/58.89–58.95, 57/91, 93, 97, 209

[56] References Cited

U.S. PATENT DOCUMENTS

| | | | |
|---|---|---|---|
| 3,091,909 | 6/1963 | Taylor et al. | 57/91 X |
| 3,113,413 | 12/1963 | Jacobs et al. | 57/91 X |
| 3,354,627 | 11/1967 | Cezik et al. | 57/58.89 X |
| 3,449,899 | 6/1969 | Ceueton et al. | 57/91 X |
| 3,455,095 | 7/1969 | Makeham et al. | 57/58.89 X |
| 3,760,576 | 9/1973 | Le Chatelier et al. | 57/58.89 X |
| 4,023,336 | 5/1977 | Kiusche et al. | 57/58.89 X |

*Primary Examiner*—Charles Gorenstein

*Attorney, Agent, or Firm*—Earle R. Marden; H. William Petry

[57] ABSTRACT

A random signal generator using a maximum-length shift register sequence to provide control pulses to a slub yarn producing open end spinning system. The time between control pulses is random to prevent any discernible pattern appearing in the fabric made from the yarn.

10 Claims, 4 Drawing Figures

RANDOM SIGNAL GENERATOR FOR THE MANUFACTURE OF SLUB OPEN END SPUN YARN

It is an object of the invention to provide a slub yarn made by an open end spinning machine by changing the speed of the yarn exit from the rotor of the open end spinning machine.

Other objects and advantages of the invention will become readily apparent as the specification proceeds to describe the invention with reference to the accompanying drawings, in which.

Figure 1:
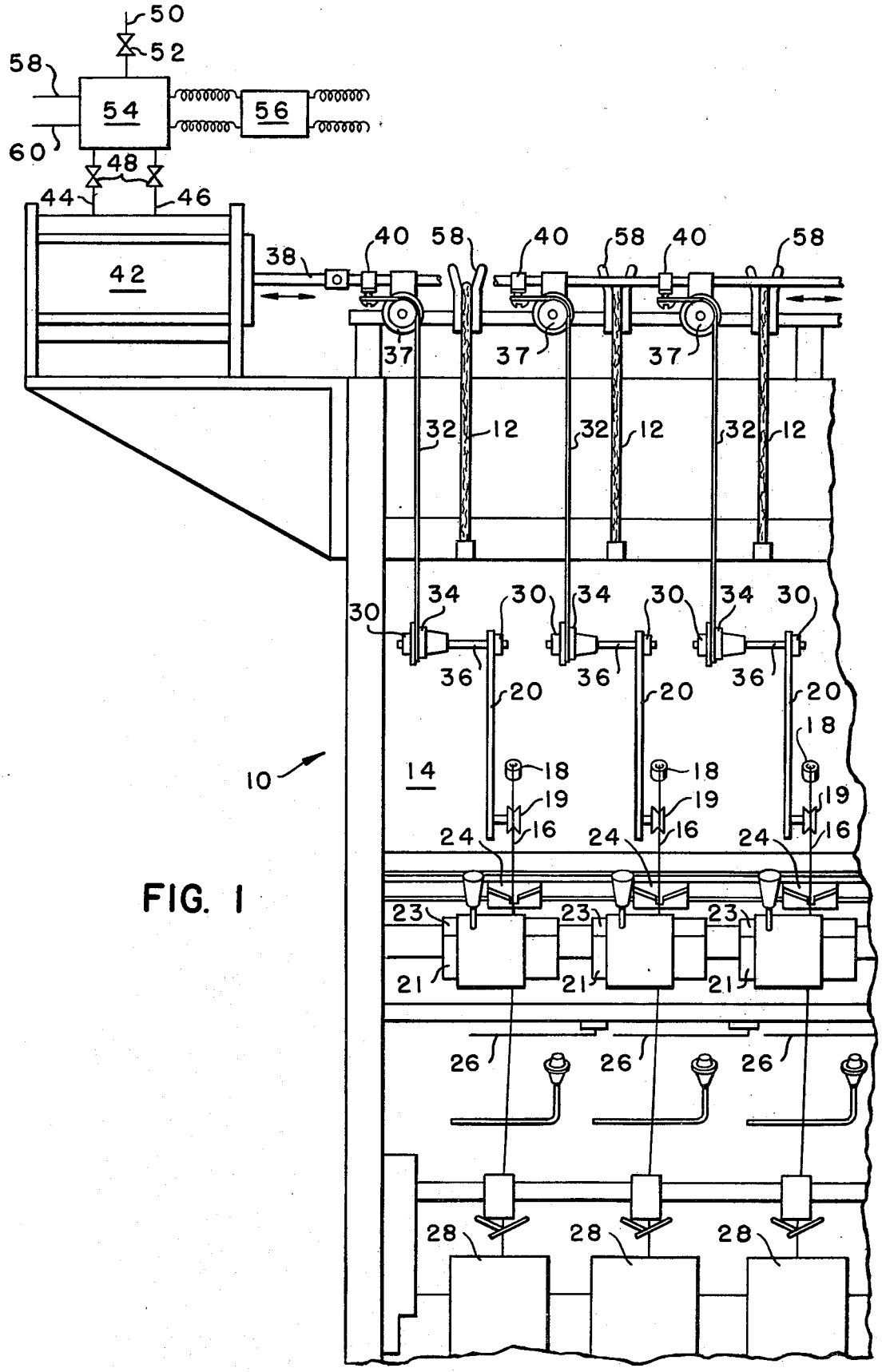
FIG. 1 is a front elevation view of an open end spinning machine incorporating the novel slub producing device.

This invention involves a new method of making slub or thick and thin yarns with twist variation on open end spinning machines by rapidly changing the speed of the yarn as it exits from the rotor. In that yarn size is dependent on yarn exit speed from the rotor, rapid change in exit speed produces abrupt changes in yarn size. This invention utilizes special yarn guide movements to change the length of yarn path between the rotor and the constant speed delivery rolls. Yarn is alternately stored and released by guide movements. When the yarn path is lengthened (i.e. excess yarn stored), velocity from the rotor must increase and a lighter weight or finer yarn is made. While not essential, this motion is usually relatively slow and of a relatively long duration so that the velocity increase is small; this results in a section of yarn only slightly finer than the normal base yarn, and the length of the fine section is relatively long. When the yarn path is shortened (i.e. the excess yarn released from storage), the yarn velocity from the rotor is reduced and a heavier weight or courser yarn or slub is made. This motion is usually fast and of a brief time period so that a large and abrupt reduction in yarn velocity from the rotor is achieved; this produces a slub or short section of yarn much courser than normal. There are various combinations of velocity changes (above and below normal velocity), and times of the velocity changes which can be used to produce thick and thin yarns of long or short sections.

Open end or break spinning involves a number of well known steps. Staple fibers in the form of sliver are fed into a drafting zone which may either be similar to the multiple pairs of nip rolls with fiber-control aprons as used very conventionally in ring spinning machines, or, more usually, consist of a high speed combing roll or beater roll which has many protrusions of pins or wires similar to card clothing. The high tip speed of the combing roll protrusions accelerate the fibers through a partial peripheral path of the combing roll, tends to straighten and parallelize them, separates them from surrounding fibers, and drafts the relatively large, slow moving bundle of fibers in the sliver to a relatively fine stream of fibers moving at high velocity. With the aid of air flow, the fibers pass from the combing roll across a "break" to the "open end" of the rapidly rotating end of a forming yarn, to which they attach themselves. The classic open end spinning scheme involves a simple means of rotating only the forming end of yarn; this is possible in that the growing or forming end of the yarn is open, i.e. there are discrete spaces between the individual fibers moving toward the end of yarn. Rotating only the tip end of the yarn requires relatively little power and can be done at very high speeds. In practice, the twisting of the end of yarn is achieved by collecting the fibers on the inside face of a high speed rotor and forming the twisted yarn as it peels off toward the center of the rotor. The yarn is then removed from the rotor axially through a doff tube by the nip action of a pair of delivery rolls through which the yarn passes as it goes on to a take-up package.

The velocity of removal of yarn from the rotor is selected so as to produce a yarn composed of the desired average number of fibers per cross section, (i.e. the desired yarn weight). Normally an effort is made to control carefully and uniformly both the rate of input of fibers to the rotor as well as output velocity of yarn from the rotor; this is done to produce yarns with maximum uniformity of size. This invention is for a system designed to purposely vary the output velocity of the yarn from the rotor so as to produce yarn with purposeful variations in uniformity and twist. This may be a gradual and/or subtle variation of yarn size to yield a unique "nervous or flutter" look in the fabric made from the yarn, or it may have abrupt variations resulting in thick and thin yarns which shows gross diameter differences when put into fabric.

The minimum length slub capable of being produced by this invention is essentially the length of the inside circumference of the rotor and is achieved by momentarily reducing yarn exit velocity from the rotor to zero. During this moment, the fibers continue to enter the rotor and build up in the rotor as an embryo yarn section. Also, during this moment of zero yarn velocity, the section of yarn between the peel-off point (where the yarn joins the fibers in the rotor) and the doff tube is continually twisted by the rotation of the rotor. This results in the unique yarn construction where the neck or section of yarn immediately preceeding the slub has an usually high number of turns or twists per unit length of yarn. This high twist neck may be weaker than either the normal yarn or the slub and appears to be finer because it is more dense, although it is essentially the same weight per unit length as the normal base yarn. During the moment of the zero yarn velocity, the twist buildup in the neck may contract the yarn slightly and cause it to pull away from the peel-off point and may form a small amount of additional yarn even though the exit yarn velocity is essentially zero.

After the moment of zero velocity, the exit yarn speed rapidly accelerates back to normal velocity. The accumulation of fibers is pulled through from the rotor as it continues to rotate and twist is inserted into the slub. The slub has a minimum theoretical length equivalent to the length of the rotor circumference.

In that the twist is inserted as the slub yarn is produced at the peel-off point, it possesses good tensile strength. Slub yarns made on ring spinning equipment often have lower twist per unit length resulting in abnormally low tensile strength in the slub as well as low density in the slub, both of which often causes difficulty in weaving and knitting. It is important in this invention that a moment of normal yarn velocity exist following the zero velocity slub forming so that the slub is removed at near normal speed to assure adequate twist in the slub.

Next, the yarn velocity may again be reduced to zero to form another slub. Or, as is necessitated by the particular yarn storage device described in this invention, the yarn velocity is increased above normal and a section of fine or light weight yarn is produced due to more rapid removal of yarn from the rotor. While the velocity increase could be great, this is not usual in that a great reduction in yarn weight results in a great reduction in yarn tensile strength which is normally undesirable. A slight increase in yarn velocity for a period of time greater than the zero velocity time, produces a slightly finer yarn whose length is greater than the slub length. This fine yarn possesses fewer turns of twist per unit length; this may contribute somewhat more to reduced tensile strength.

While the high velocity time period can be followed immediately by a low or zero velocity time, a time period of normal velocity will allow normal weight yarn to be produced following the fine yarn. This usually is a choice of esthetics rather than physical performance.

Figure 2:
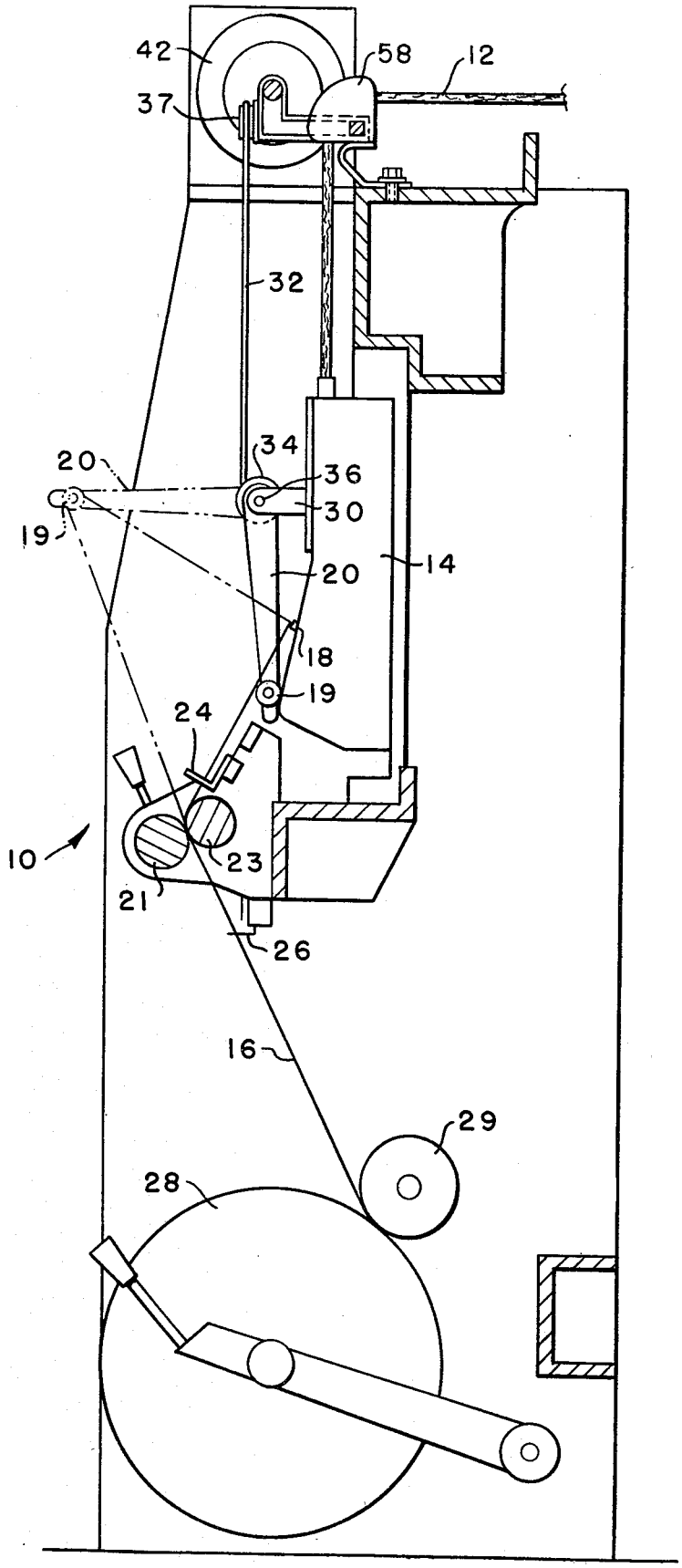
FIG. 2 is a side elevation view of the open end spinning machine shown in FIG. 1.

Looking now to the drawings, the invention will be described in detail. FIGS. 1 and 2 represent several positions of an open end spinning frame 10 with each position being supplied roving or sliver 12 from a supply can (not shown). The roving 12 is delivered into the housing 14, which contains the conventional combing roll and rotor (not shown), to be acted upon by the rotor to produce the spun yarn 16. From the rotor in the housing 14, the yarn 16 exits through the doff tube 18 and passes over the pulley 19 on the lever arm 20 to the nip of rolls 21 and 23 through the guide 24. From the nip or delivery rolls 20 and 24 the yarn passes through the conventional ends-down detector 26 to the take-up roll 28 driven by the surface drive roll 29.

As discussed previously, it is desired to produce slub or heavy weight yarn portions in the yarn being spun. Basically, this is accomplished by alternately increasing and decreasing the length of the yarn path from the doff tube 10 to the take-up roll 28. To accomplish this variation in the length of the yarn, the level member or arm 20 is pivotally mounted at each spindle position to the brackets 30. Looking at FIG. 2, it can be seen that the spun yarn 16 passing over the pulley 19 travels a shorter path when the lever arm 20 is in the (solid line) down position rather than when the lever arm 20 is in the up (dotted line) position. The pivotal movement of the lever arm 20 is controlled by the pulley chain 32 connected to the pulley 34, which, along with the lever arm 20 are fixed to the shaft 36 rotably mounted on the brackets 30. The upper end of the chain 32 passes over an idler pulley 38 and is connected to the reciprocating rod 38 by means of a clamp 40, as hereinafter explained, the rod 38 is reciprocated by the double acting air piston 42. Air is supplied to and returned from the air cylinder 42 by conduits 44 and 46 through suitable flow valves or regulators 48. Air under pressure is supplied from conduit 50 through a suitable pressure regulator 52 to the multi-way solenoid operated flow control device 54 which controls the flow of air in the conduits 44 and 46 to the air piston as well as through exit conduits 58 and 60. The device 54 is electrically controlled from a random signal generator 56 powered by an external source of electricity. Random signal generator 56 can be of any suitable type such as a continuous magnetic type player with random signals on the tape or a multiple shift register type. Flow valves or regulators 48 operate undirectionally so that flow of air to the air piston is unmodulated but can be modulated in the reverse direction to the flow control device 54 to exhaust the supplied air through either conduit 58 or 60 depending on the selected position of the solenoid in flow control device 54.

OPERATION

The sliver 12 of staple fibers such as acrylic, polyester, polyester-cotton, polyester-rayon, cotton or rayon is supplied from the sliver cans (not shown) over a suitable guide 58 into the rotor (not shown) in the housing 14 of the open-end spinning machine 10. As discussed previously the spun yarn 16 from the doff tube 18 is delivered to the feed rolls 21 and 23 over the pulley guide 19, from whence it is delivered to the take-up roll 28. The feed rolls 21 and 23 are driven at a constant speed and, for the sake of discussion assume that the lever 20 is in the down position (solid line position is FIG. 2) and normal twist, normal weight open end spun yarn 16 is being produced. Then, as the rod 38 (FIG. 1) is pulled to the left by air cylinder 42, the lever arm 20 is pivoted upward towards the dotted line position by the pulley chain 32. Since the feed rolls 21 and 23 are driven at a constant speed and the rotor of the open end spinning machine rotates at a constant speed, the velocity of the yarn from the doff tube 18 will increase due to the longer yarn path as the lever 20 pivots upwardly resulting in the production of a finer or lighter weight yarn, as indicated at 60 in FIG. 3. Then at the appropriate time, a signal from the random signal generator is delivered to the flow control device 54 and air is delivered suddenly into the left hand side of the air cylinder 42 through conduit 44 while air is exhausted through conduit 46 to cause the air cylinder 42 to rapidly move the rod 38 to the right. This rapid movement of the rod 38 causes the lever 20 to pivot rapidly down to the solid line position to momentarily reduce the yarn exit velocity from the doff tube 18 to substantially zero. During the period of zero yarn exit velocity, fibers continue to accumulate in the rotor until pulled out by the action of the feed rolls 21 and 23. The yarn 16 pulled out has a neck portion 62 of high twist, substantially normal weight, just prior to the twisted slub portion 64 of high weight, which has accummulated during the period of zero exit velocity. Then the random signal generator 56 delivers another signal to the flow control device to reverse the action of the air cylinder 42 and the cycle starts all over again.

It should be kept in mind that the timing of the signals from the random signal generators are not usually equally spaced so that the slubs 64 generated are not evenly spaced throughout the yarn 16 produced. Further, it is obvious that adjustments to the slub producing mechanism, such as length of lever 20 or position and/or location of pulley 19, can be made to vary the characteristics of the yarn produced.

The following examples are characteristics of the capabilities of the above described apparatus:

EXAMPLE 1

Apparatus similar to that shown in FIGS. 1 and 2 was installed on a Platt model 885 open end spinning machine with a 51 mm I.D. (2.15 inch) rotor producing 10.75's cotton count (c.c.) yarn from 64 grain/yd., $1\frac{1}{2}$ denier×9/16 inch bright rayon staple fiber. The guide arm was 5 inches long and was intermittently raised and lowered from a lower position essentially vertical so that the yarn guide was disengaged from the yarn, to a position slightly higher than the horizontal. This increased the yarn path for about seven inches normal to about 19 inches for a yarn storage of about 12 inches. The input air pressure from the regulator to the air valves was 60 PSIG. Flow valve settings were adjusted so that the arm moved up slowly in about three seconds but down quickly in about 0.1 second or less. The arm paused in the down position for about 0.5 seconds and in the up position for random times averaging about one second. A solid state random signal generator activated the system to 12–14 cycles per minute average. The rotor speed was 38,500 RPM, the combing roll speed was 4,900 RPM, the draft was 83, and the yarn twist averaged 13.1 TPI. The yarn produced has excellent slubs about six inches long with a primary weight of three to three and one-half times the average weight of the base yarn as measured on a modified Uster Uniformity Analyzer. Slubs were randomly spaced along the length of the yarn, spacing varying for approximately 135 to 335 inches apart. The skein tensile strength of the slub yarn averaged about 150 pounds when measured on the Scott Tester as compared with about 200 pounds for the same yarn construction made smooth without slubs. The ends down rate during spinning was only slightly higher than the smooth yarn. The slub yarn was used to weave a drapery fabric.

EXAMPLE 2

A rayon yarn similar to them of Example 1 was made on the same equipment but with the Random Signal Generator adjusted to give about 24 cycles per minute. The up movement consumed above 1.5 seconds, the pause in the up position varied from 0 to about 1.0 second or less; and the pause at the bottom of the stroke was about 0.3 seconds; the average time per total cycle was about 2.4 seconds.

The yarn ran good with ends-down rate acceptable although higher than normal smooth yarns.

The yarn was measured on the Uster and found to contain primary slubs 3.1 to 3.8 times the weight of the yarn average, and with secondary slubs 3.9 to 4.8 times the weight of the yarn average. The primary slub is the average of the majority of the approximately six inches long torpedo shaped slub; the secondary slub is the small accummulation of excess fibers which often occur along the primary slub causing a small but noticeable "nub" of larger size and higher weight.

EXAMPLE 3

A rayon yarn was made on the apparatus similar to that of Example 1 but with the arm intermittently raised to a position about 30° above the horizontal (to "2 o'clock") and the signal timing and air pressure adjustments made to cause the arm to move up in about 2.6 seconds, to pause up for zero to about 2.6 seconds, to come down abruptly and pause down for during a period of about 0.4 seconds. This produced a yarn with slubs, randomly spaced having a weight about four times normal weight per unit length. The turns per inch of twist was determined along the length of this yarn. It was evident that there is a high twist neck adjacent to each slub and each slub had a twist less than the twist of the high twist neck. This characteristic was true of all yarns in the above examples.

Figure 4:
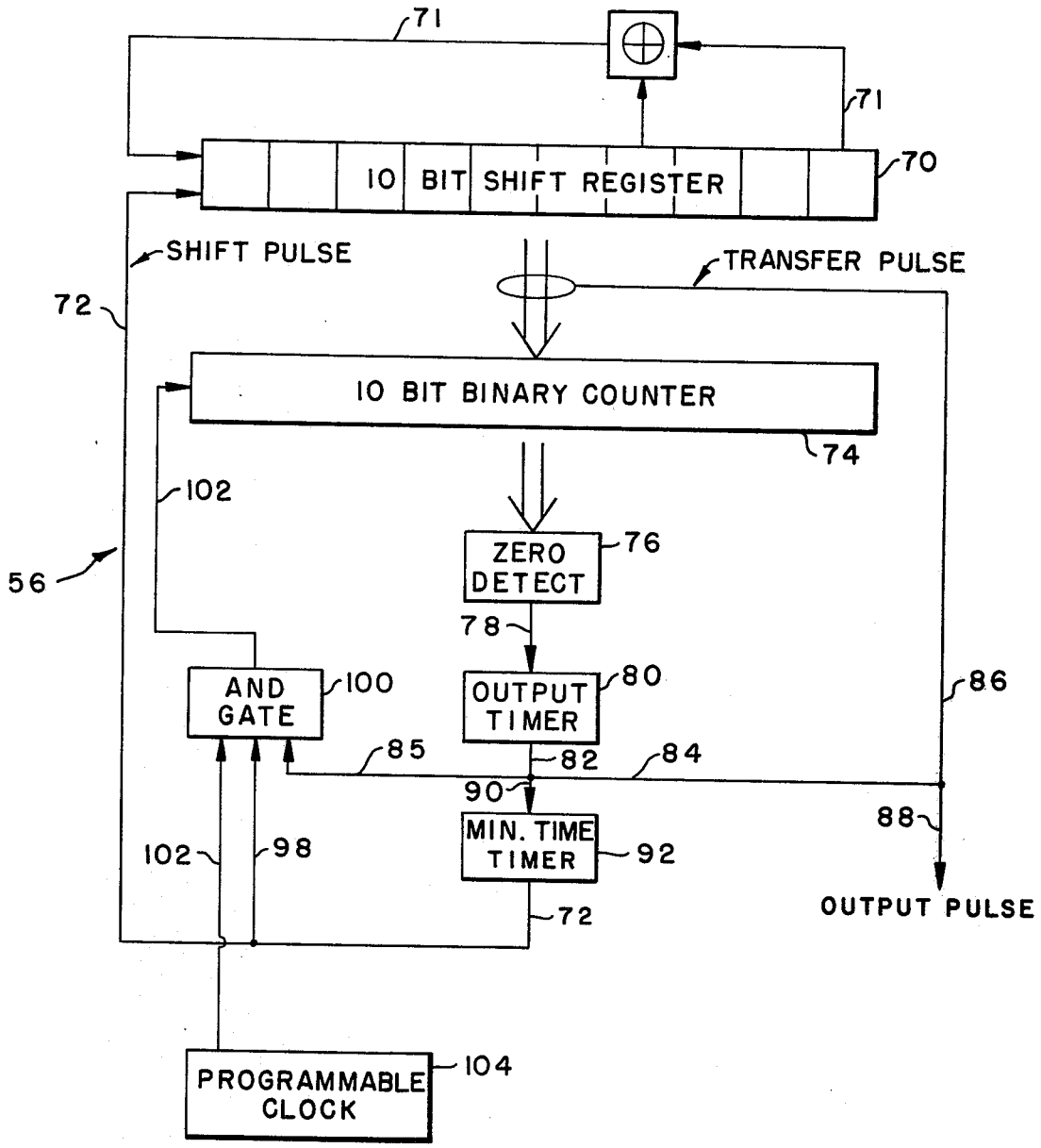

Looking now to FIG. 4, the operation of the random signal generator 56 will be explained. The design of the random signal generator is based on a maximum-length shift register sequence known in the art and in the preferred form of the invention employs a ten bit shift register 70 with a conventional feed back 71 to provide 1023 unique bit combinations before beginning to repeat any combinations.

Assume, for the sake of discussion, that a shift pulse 72 has occurred and afterwards, the contents of the shift register 70 have been parallel transferred to the 10 bit binary down counter 74. The counter 74 is clocked until the zero condition is detected by the zero detector 76 which by a suitable signal 78 actuates the output timer 80. The output timer 80 produces a pulse which for the sake of discussion is indicated by reference numbers 82, 84, 85 and 90. The pulse of the output timer represented by 84 is employed as the transfer pulse 86 which transfers the contents of the shift register 70 to the counter 74 and the output pulse 88 to the flow control device 54 to produce the desired slub. The pulse represented by reference number 85 disables AND gate 100 during the duration of the output pulse and thereby prohibits clock pulses 102 from reaching the counter 74. The pulse from the output timer 80 represented by 82 and 90 triggers the minimum time timer 92. The output signal from the timer 92, which is initiated by the termination of the pulse represented by 82 and 90, provides the shift pulse 72 to shift the shift register 70 and the pulse 98 to the AND gate 100 to disable the clock pulse 102 from the programmable clock 104. When the timer 92 has timed out the clock pulses 102 will be delivered to the binary counter 74 to clock the counter to zero as hereinbefore explained. Obviously, the time between output pulses 88 is the sum of the time set into the timer 92 and the random time interval which is the time required to clock the counter to zero. The random time interval is the time required to clock the ten bit binary counter 74 to zero and is random to the extent that the bit combinations from the shift register are different within the capabilities of the shift register to produce different shift combinations.

If desired, the random time interval range can be varied by adjustment of the frequency of the programmable clock 104.

Figure 3:
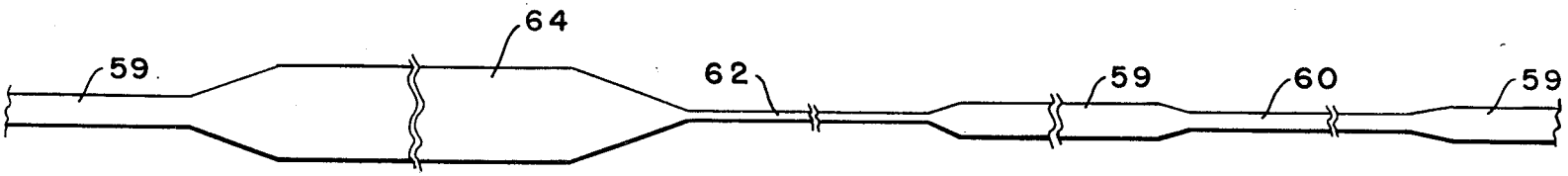
FIG. 3 is a schematic representative of the slub yarns produced on the open end spinning machine shown in FIGS. 1 and 2; and, FIG. 4 is a schematic diagram of a random signal generator used to provide the control pulse for the slub producing mechanism.

In the description of the invention, the terms normal twist, normal weight and normal yarn diameter refers to open end yarn spun when the lever arm 20 is in the solid position after the yarn velocity has stabilized or the lever arm 20 is in some other position and has remained in such position long enough for the yarn velocity to stabilize. These conditions are true since the speed of the feed rolls 21 and 23 and the speed of the rotor on the housing 14 are continuous and constant. The slub yarn of FIG. 3 is produced when the yarn path is being altered. The yarn of FIG. 3 is the preferred configuration and includes a section of normal yarn 59 between the fine yarn 60 and the neck yarn 62 by stabilizing the position of the lever arm 20 for a pre-determined period of time. The critical relationship in the yarn is that the yarn produced has a high twist, normal weight portion 62 next adjacent to a lower twist, higher weight slub portion 64. In the preferred form of the invention the relative diameter of the yarn portions shall such that the diameter of portion 59 is normal, the diameter of the portion 60 is smaller than normal, the diameter of the portion 62 be smaller than normal and the diameter of yarn portion 64 be larger than normal.

In the preferred form of the invention shown in FIGS. 1–3, when the end is pieced-up after a break, or upon start-up, an operator has to place the yarn 16 onto the pulley 19 but it is contemplated that the pulley could be replaced by a U-shaped hook guide which, in the down stride of the arm 20 will push the yarn outwardly off the hook until it slips over the edge thereof and fall into the bottom of the U-shape and then, from there on out will act in the same manner as the pulley 19. This hook guide eliminates the manual operation of placing the yarn into or onto the guide upon start-up.

It can be seen that a novel apparatus has been described which will produce a novel slub open-end spun yarn with a minimum amount of modification of the basic open-end spinning apparatus.

Although I have described specifically the preferred embodiments of my invention, I contemplate that changes may be made without departing from the scope or spirit of my invention, and I desire to be limited only by the scope of the claims.

That which is claimed is:

1. Apparatus to produce slub open end spun yarn comprising: a frame, a housing on said frame, means in said housing to produce open end spun yarn, a doff means in communication with said means to produce the open end spun yarn, a yarn take-up roll mounted on said frame, a pair of rolls in nip forming relationship mounted in said frame receiving open end spun yarn from said doff means and supplying said yarn to said take-up roll and means operably associated with said doff means to periodically increase the length of the yarn path between said doff means and said nip rolls and to abruptly decrease the velocity of the yarn from the doff means to substantially zero to allow a fiber build-up in said means to produce an open end spun yarn and to produce a slub in the subsequent open end yarn exiting from said doff tube, said means to periodically increase the length of the yarn path includes a random signal generator, said random signal generator includes a means to allow the number of slubs per unit time to be preselected.

2. The apparatus of claim 1 wherein said random signal generator includes a shift register.

3. The apparatus of claim 1 wherein said random signal generator includes a shift register and a digital counter, said digital counter being controlled by a programmable clock to send a clock pulse to said binary counter.

4. The apparatus of claim 2 wherein said random signal generator includes a timer to control when said clock pulse is sent to said digital counter.

5. Apparatus to produce slub open end spun yarn comprising: a frame, a housing mounted on said frame, means to supply staple fibers into said housing, a first means in said housing to open end spin staple fibers, doff means connected to said housing and in communication with said first means, a pair of rolls in nip forming relationship mounted on said frame receiving open end spun yarn from said doff means, lever means pivotally mounted to said apparatus in the path of travel of the yarn from the doff means to said pair of rolls, means to periodically pivot said lever means upwardly to increase the path of travel of said yarn and to abruptly pivot said lever means downwardly to momentarily decrease the yarn velocity from said doff means to substantially zero, said means to periodically pivot said lever means includes a pulley arrangement moved by an air cylinder means with the flow of air to and from same being controlled by a flow control arrangement actuated by a random signal generator, said random signal generator including a means to allow the number of slubs per unit time to be pre-selected.

6. The apparatus of claim 5 wherein said pulley arrangement is connected to a rod member which is moved back and forth by said air cylinder means.

7. The apparatus of claim 5 wherein said random signal generator includes a shift register and a digital counter, said digital counter being controlled by a programmable clock to send a clock pulse to said digital counter.

8. The apparatus of claim 7 wherein said random signal generator includes a timer to control when said clock pulse is sent to said digital counter.

9. The method of producing a slub open end spun yarn comprising the steps of: supplying open end spun yarn from the doff means of an open end spinning machine, supplying the open end spun yarn from the doff means to a take-up roll at a substantially constant rate, periodically increasing the length of the yarn path from the doff means to the take-up roll to increase the velocity of the yarn and periodically and abruptly reducing the velocity of the yarn being supplied from the doff means to substantially zero to allow a build-up of fibers in the open end spinning machine to allow the production of a slub in the yarn being supplied from the doff means by generating a substantially random control signal and supplying the control signal to a control device which is used to reduce abruptly the velocity of the yarn.

10. The method of claim 9 wherein the generated substantially random control signal is pre-selected to produce a selected number of slubs per unit time.

* * * * *